US011398698B2

(12) United States Patent
Nakamura et al.

(10) Patent No.: US 11,398,698 B2
(45) Date of Patent: Jul. 26, 2022

(54) CONNECTOR

(71) Applicant: Yazaki Corporation, Tokyo (JP)

(72) Inventors: Masatoshi Nakamura, Makinohara (JP); Nobuyuki Mukoujima, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/230,599

(22) Filed: Apr. 14, 2021

(65) Prior Publication Data

US 2021/0367371 A1 Nov. 25, 2021

(30) Foreign Application Priority Data

May 19, 2020 (JP) ..... JP2020-087124

(51) Int. Cl.
*H01R 13/506* (2006.01)
*H01R 13/627* (2006.01)
*H01R 13/436* (2006.01)

(52) U.S. Cl.
CPC ..... *H01R 13/506* (2013.01); *H01R 13/6272* (2013.01); *H01R 13/4364* (2013.01)

(58) Field of Classification Search
CPC ..... H01R 13/6272; H01R 13/4364; H01R 13/506
See application file for complete search history.

(56) References Cited

U.S. PATENT DOCUMENTS 5,848,912 A * 12/1998 Okabe ..... H01R 13/641 439/352
9,543,707 B2 * 1/2017 Miyoshi ..... H01R 13/502
9,979,123 B2 * 5/2018 Sekino ..... H01R 13/4362
11,327,252 B2 * 5/2022 Hikosaka ..... H01R 13/502
2003/0143885 A1 * 7/2003 Nishide ..... H01R 13/641 439/352

FOREIGN PATENT DOCUMENTS

EP 0951100 A2 10/1999
JP 2008-071599 A 3/2008
JP 2018-098114 A 6/2018

* cited by examiner

*Primary Examiner* — Briggitte R. Hammond
(74) *Attorney, Agent, or Firm* — Sughrue Mion, PLLC

(57) ABSTRACT

A connector includes a female housing and a male housing. An arm portion of the female housing engages with an engagement projection of the male housing. In a state where the engagement projection is fitted to an opening of the arm portion, a gap for insertion of a jig exists in the opening at a lateral side of the engagement projection. A groove-shaped release operation portion is formed on the male housing at a lateral side of the engagement projection. An inclined surface is formed at a rear end of the release operation portion, and a wall portion is formed on a rear side of the inclined surface. The arm portion engaged with the engagement projection can be released with a simple operation including inserting the jig into the release operation portion from the gap in the opening and pushing the jig in the same direction as the insertion direction.

4 Claims, 6 Drawing Sheets

- Prior Art -

- Prior Art -

CONNECTOR

TECHNICAL FIELD

The present invention relates to a connector.

BACKGROUND

FIGS. 9A and 9B show a conventional connector (refer to Patent Document 1). This connector 630 includes a housing 631 accommodating a female terminal and a front holder 650 mounted so as to be movable with respect to the housing 631 between a provisionally-engaged position and a completely-engaged position.

The front holder 650 detects an incomplete insertion of the female terminal during the movement from the provisionally-engaged position to the completely-engaged position, and performs double engagement of the female terminal by being positioned in the completely-engaged position (i.e., restricts deflection of a female terminal retaining lance not shown). Further, FIGS. 9A and 9B illustrate the front holder 650 that is about to release a completely-engaged state where the front holder 650 is positioned to the completely-engaged position and completely engaged with the housing 631.

The front holder 650 includes a complete engagement elastic arm 657 having a complete engagement projection 657*a* that engages with a complete engagement hole 644 formed in the housing 631. The complete engagement elastic arm 657 includes an insertion opening 657*b* for a jig 658 that is arranged at an inner side with respect to a complete engagement projection 657*a*. The jig 658 is arranged to release the completely-engaged state of the front holder 650. This insertion opening 657*b* is arranged along a direction orthogonal to the movement direction of the front holder 650 from the provisionally-engaged position to the completely-engaged position.

To release the completely-engaged state of the front holder 650 to shift to the provisionally-engaged position, a distal end 658*a* of the jig 658 is inserted into the insertion opening 657*b* to lift the complete engagement elastic arm 657, and, while maintaining this state, the jig 658 is operated toward the provisionally-engaged position orthogonal to the insertion direction so as to engage the jig 658 with the complete engagement projection 657*a*. In this manner, the completely-engaged state of the front holder 650 is released, allowing to shift from the completely-engaged position to the provisionally-engaged position.

PRIOR ART DOCUMENT

Patent Document 1: JP 2018-98114 A

SUMMARY OF THE INVENTION

Problem to be Solved by the Invention

In the conventional connector 630 described above, when releasing the completely-engaged state of the front holder 650 and shifting to the provisionally-engaged position, it requires a complex operation including inserting the jig 658 into the insertion opening 657*b* to lift the complete engagement elastic arm 657 and moving the jig 658 to the direction orthogonal to the insertion direction.

In view of this, an object of the present invention is to provide a connector which includes an engagement projection and an arm portion and which has a structure capable of releasing, with a simple operation, engagement of the arm portion engaged with the engagement projection.

Solution to the Problem

In order to achieve the above-described object, the present invention provides, in one aspect, a connector including: a first housing and a second housing that are configured to be fitted to each other; an engagement projection formed on the second housing so as to protrude from an outer surface of the second housing; an arm portion that is formed on the first housing and that is configured to engage with the engagement projection, the arm portion having an opening to which the engagement projection is fitted, wherein, in a state where the arm portion is engaged with the engagement projection and the engagement projection is fitted to the opening, a gap for insertion of a jig exists in the opening at a lateral side of the engagement projection, the lateral side being adjacent to the engagement projection in a direction orthogonal to a fitting direction in which the second housing is fitted to the first housing, the second housing includes a release operation portion, the release operation portion being formed as a recess on the outer surface of the second housing and being arranged such that the jig is insertable from the gap, the release operation portion extending to a rear side in the fitting direction with respect to the engagement projection, and an inclined surface is formed at a rear end in the fitting direction of the release operation portion, the inclined surface being continuous with the outer surface of the second housing.

Advantageous Effect of the Invention

According to the present invention, it is possible to release, with a simple operation, the engagement of the arm portion engaged with the engagement projection.

DETAILED DESCRIPTION OF THE EXEMPLARY EMBODIMENTS

A connector according to one embodiment of the present invention will be described with reference to FIGS. 1-8.

Figure 1:
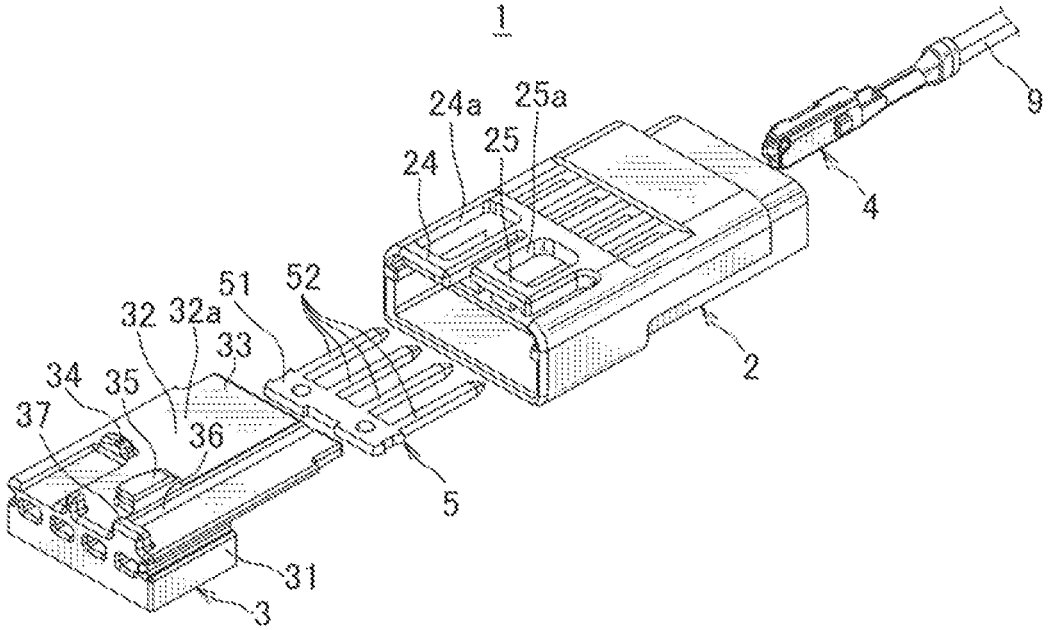
FIG. 1 is an exploded view of a connector according to one embodiment of the present invention.

A connector 1 shown in FIG. 1 includes a female terminal 4, a female housing 2 (corresponding to "first housing") having a female terminal accommodating space 21 for accommodating the female terminal 4, a bus bar 5 having a male terminal 52 that is arranged to be fitted to the female terminal 4, and a male housing 3 (corresponding to "second housing") arranged to accommodate the bus bar 5 and capable of being fitted to the female housing 2.

In this example, the connector 1 is provided with a plurality of female terminals 4, and the plurality of female terminals 4 is arranged to be electrically connected to each other by the bus bar 5. The connector 1 as described above is also referred to as "joint connector".

The female terminal 4 is obtained by applying press working or the like to an electrically conductive metal plate. The female terminal 4 includes a barrel configured to crimp an electric wire 9 to be electrically connected to the electric wire 9, and a rectangular tube-shaped connecting portion to which the male terminal 52 is fitted so that the male terminal 52 is electrically connected thereto.

Figure 2:
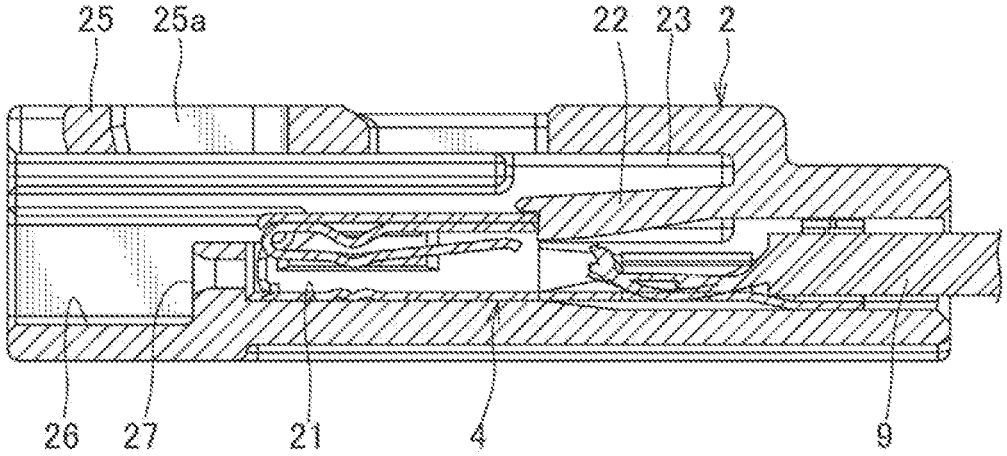
FIG. 2 is a cross-sectional view of a female housing of FIG. 1.

The female housing 2 is formed into a rectangular tube-shape from an insulating synthetic resin, and inside of the female housing 2 is partitioned into a front portion and a rear portion by a partition wall 27, as shown in FIG. 2. At a rear side of the partition wall 27, four female terminal accommodating spaces 21 which can accommodate the female terminals 4 individually are parallelly arranged along a width direction (i.e., a direction orthogonal to the fitting direction of both housings 2, 3 and corresponding to a direction perpendicular to a plane of a paper of FIG. 2). On a front side of the partition wall 27, a fitting portion 26 to which the male housing 3 can be fitted is provided.

Herein, with respect to the female housing 2, a front side thereof corresponds to the male housing 3 side in the fitting direction of both housings 2, 3, and, with respect to the male housing 3, a front side thereof corresponds to the female housing 2 side in the fitting direction of both housings 2, 3.

Further, a provisional engagement portion 24 and an arm portion 25 are formed by a part of an outer wall constituting the fitting portion 26. The provisional engagement portion 24 is arranged to engage with a later-described provisional engagement projection 34 of the male housing 3. The provisional engagement portion 24 has an elongated opening 24*a* for positioning the provisional engagement projection 34. The arm portion 25 is arranged to engage with a later-described engagement projection 35 of the male housing 3. The arm portion 25 is formed in a cantilever plate shape and has an opening 25*a* to which the engagement projection 35 is fitted.

Each female terminal accommodating space 21 is provided with a lance 22 that is arranged to engage with the female terminal 4 to retain the female terminal 4 from falling off. The lance 22 extends in a cantilever plate shape manner from the rear side to the front side of the female terminal accommodating space 21, and a distal end of the lance 22 is arranged to be engaged with a rear edge (i.e., an edge on the barrel side) of the connecting portion of the female terminal 4 The lance 22 is capable of being elastically deformed into a deflection space 23 formed on the side opposite to the female terminal 4.

The bus bar 5 is obtained by punching a conductive metal plate, and includes a strip-shaped base portion 51, and four male terminals 52 extending from the a long side of the base portion 51 and extending parallel to each other in a rod shape.

Figure 3:
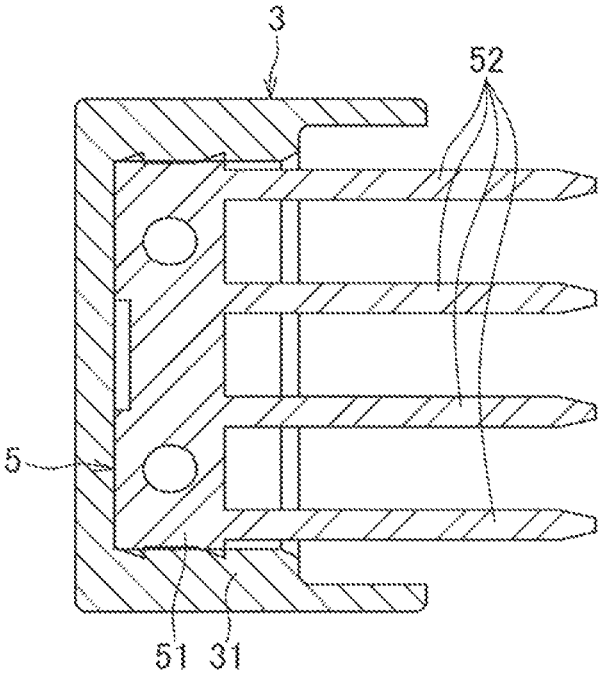
FIG. 3 is a cross-sectional view of a male housing of FIG. 1.
Figure 4:
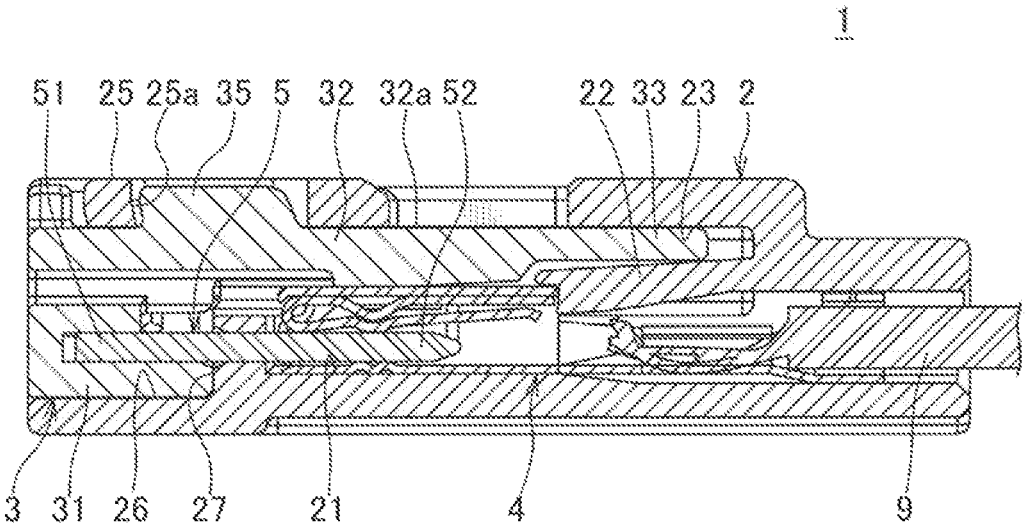
FIG. 4 is a cross-sectional view showing a completely-fitted state where the female housing and the male housing of FIG. 1 are completely fitted to each other.
Figure 5:
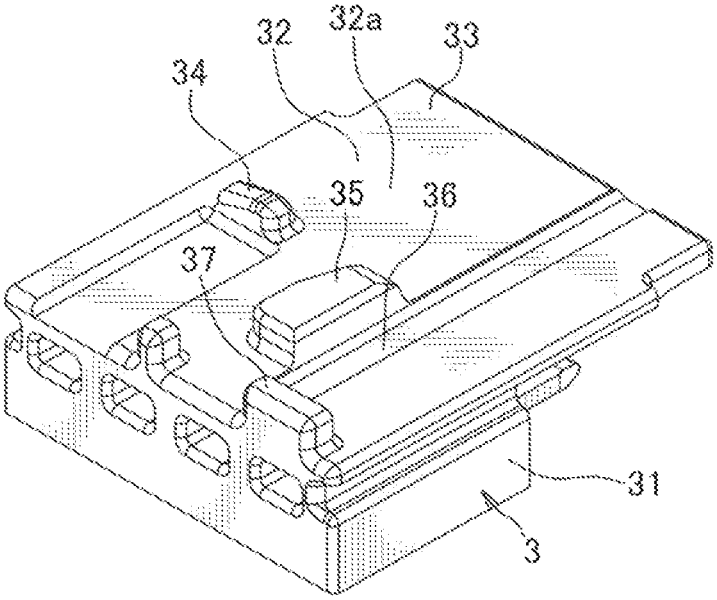
FIG. 5 is an enlarged view of the male housing of FIG. 1.

The male housing 3 is made of an insulating synthetic resin, and as shown in FIG. 3 and FIG. 5, the male housing 3 includes a holding portion 31 configured to hold the base portion 51, a plate portion 32 continuous with the holding portion 31 and extending parallel to the plurality of male terminals 52, and a plate-shaped restricting portion 33 continuous with a distal end of the plate portion 32. The male housing 3 further includes a provisional engagement projection 34, an engagement projection 35 and a wall portion 37 that are protruding from an outer surface 32*a* of the plate portion 32. The male housing 3 further includes a release operation portion 36 that is formed as a recess on the outer surface 32*a* of the plate portion 32 and that extends in a groove shape manner in the fitting direction of housings 2, 3.

In the connector 1 described above, the provisional engagement projection 34 is fitted to the opening 24*a* of the provisional engagement portion 24, thereby placing the female housing 2 and the male housing 3 in a provisionally-fitted state. At this time, the arm portion 25 and the engagement projection 35 are in a non-engaged state.

Further, in the connector 1 described above, the male housing 3 is pushed deeper into the female housing 2 from the provisionally-fitted state described above, and, as shown in FIG. 4, the engagement projection 35 is fitted into the opening 25*a* of the arm portion 25, and the arm portion 25 is engaged with the engagement projection 35, thereby placing the female housing 2 and the male housing 3 in the completely-fitted state. In the completely-fitted state shown in FIG. 4, the entire male housing 3 is positioned inside the female housing 2, the holding portion 31 is fitted into the fitting portion 26, and the restricting portion 33 is positioned in the deflection space 23.

As described above, in a state where both housings 2, 3 are completely fitted to each other, the restricting portion 33 is positioned in the deflection space 23 for the lance 22 and restricts the deflection of the lance 22 . The restricting portion 33 also functions as an incomplete insertion detecting portion for the female terminal 4. That is, in the incompletely-inserted state where the female terminal 4 is not completely inserted into the female terminal accommodating space 21, the lance 22 is placed over the female terminal 4 and is positioned in the deflection space 23. Thus, during the operation of completely fitting both housings 2, 3 to each other, the distal end of the restricting portion 33 abuts on the distal end of the lance 22 and the restricting portion 33 cannot enter the deflection space 23, hence both housings 2, 3 cannot be completely fitted to each other. The male housing 3 having the restricting portion 33 as described above is also referred to as "terminal position assurance member".

Next, the configuration of the arm portion 25 and the engagement projection 35 as well as the configuration around them will be described in more detail. In a state where the arm portion 25 is engaged with the engagement projection 35 and the engagement projection 35 is fitted to the opening 25*a*, a gap for insertion of the jig 8 exists in the opening 25*a* at a lateral side of the engagement projection 35. This "lateral side" means adjacent to the engagement projection 35 in a direction (i.e., a width direction of the male housing 3) orthogonal to the fitting direction of the housings 2, 3.

Figure 6:
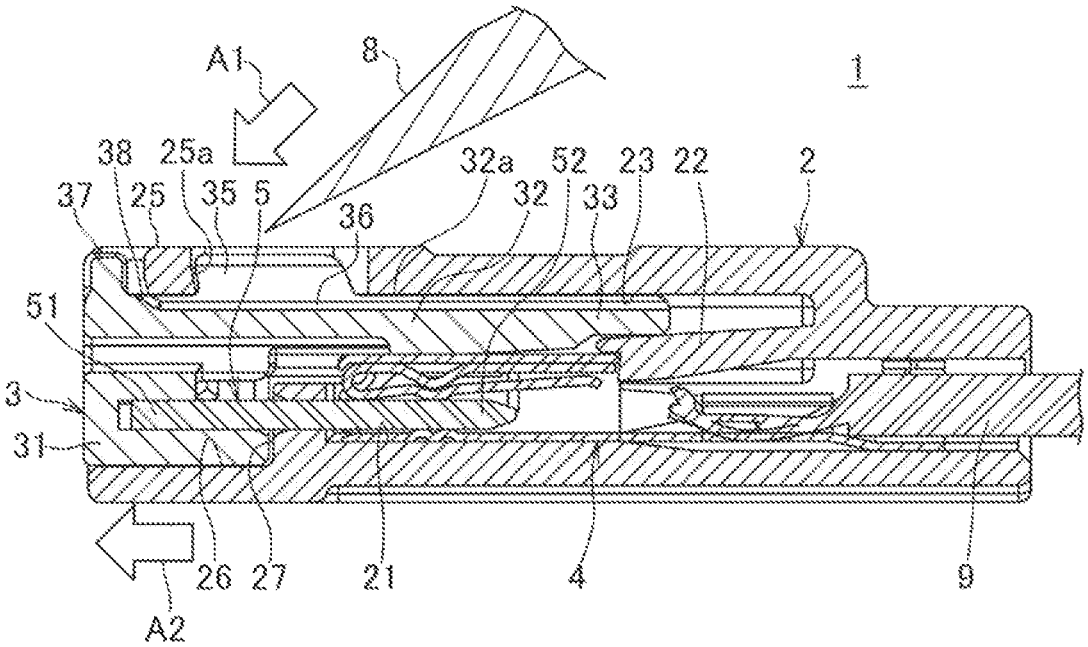
FIG. 6 shows the connector of FIG. 1 and shows an arm portion that is about to be released from an engagement projection using a jig.
Figure 7:
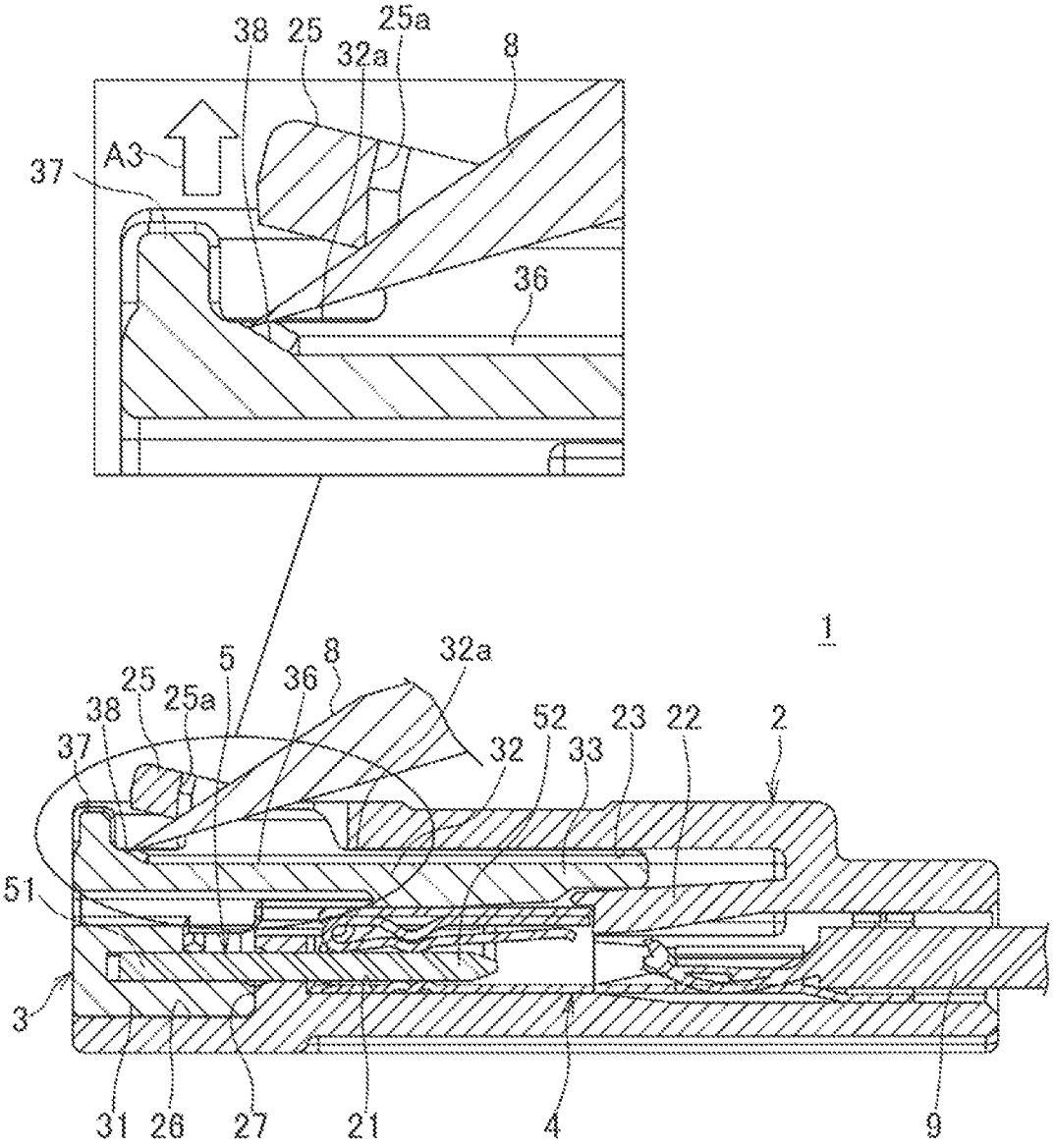
FIG. 7 illustrates the arm portion being lifted by the jig of FIG. 6.
Figure 8:
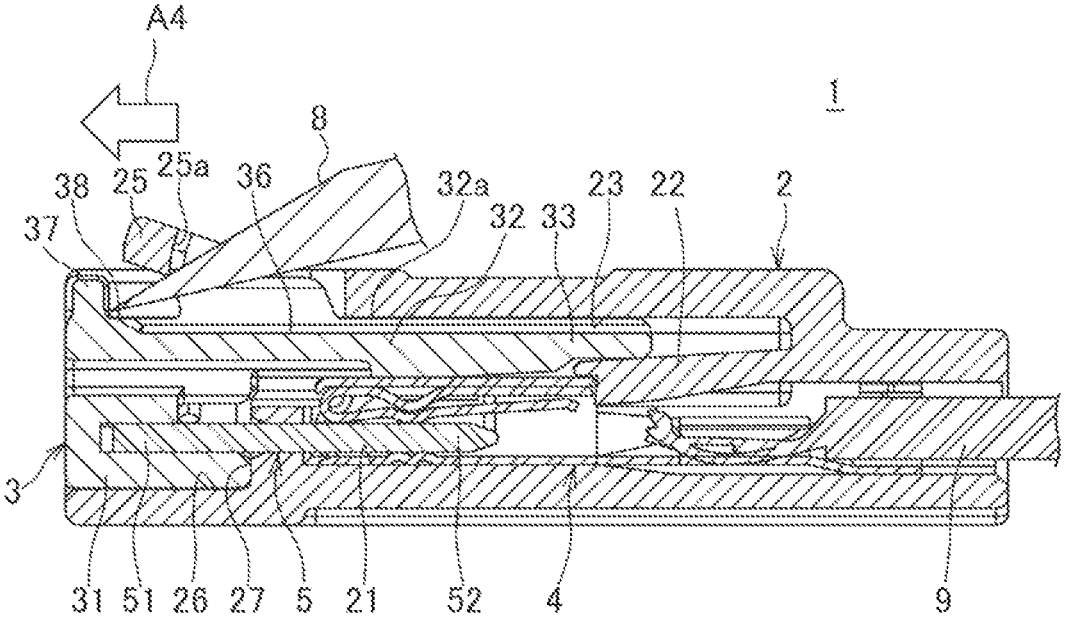
FIG. 8 illustrates the jig of FIG. 7 that is about to press the male housing in a direction opposite to a fitting direction.
Figure 9A:
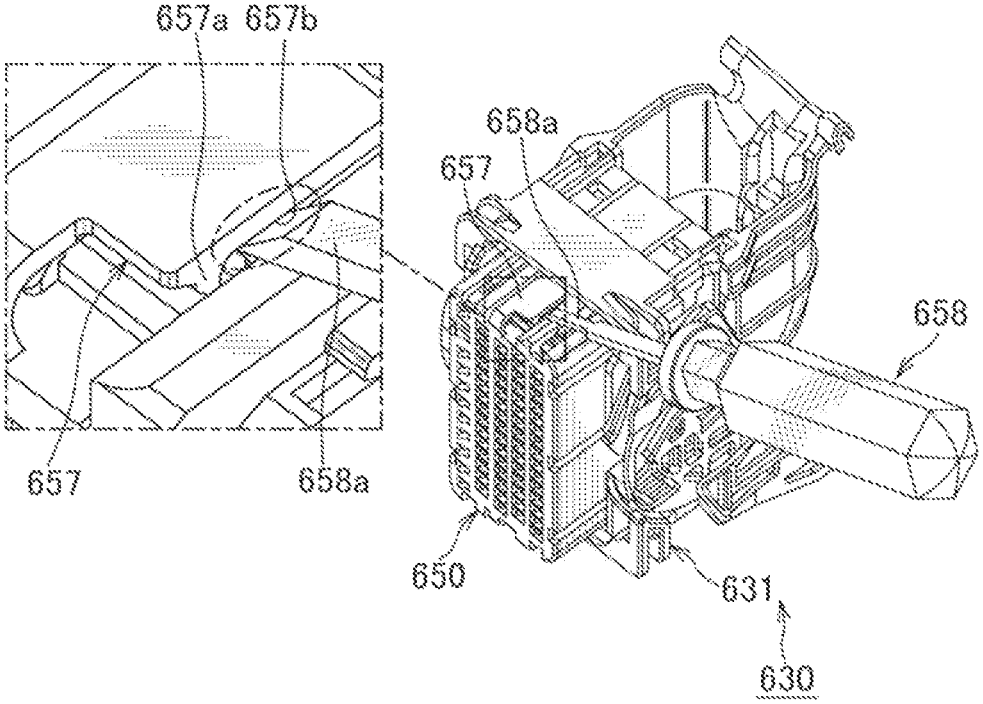
FIGS. 9A and 9B show a conventional connector.
Figure 9B:
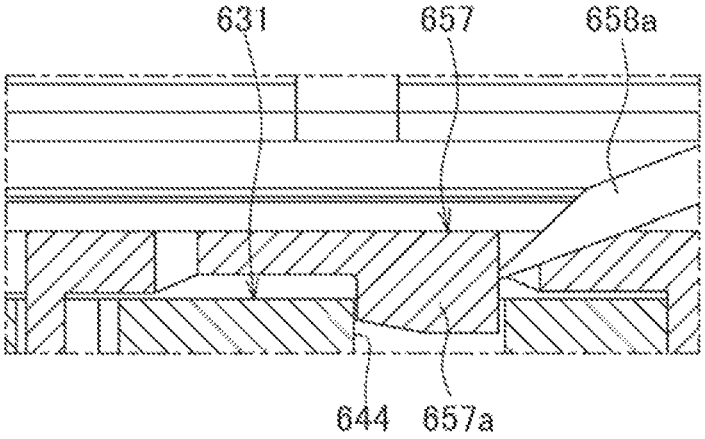

As shown in FIGS. 6-8, the jig 8 is configured to lift the arm portion 25 which is engaged with the engagement projection 35 to release the engaged state. The jig 8 is formed in a rod shape having a thickness that decreases as approaching to a distal end thereof.

The release operation portion 36 is formed on a lateral side of the engagement projection 35, and the release operation portion 36 extends from the distal end of the restricting portion 33 to a rear side with respect to the engagement projection 35. The release operation portion 36 overlaps with the gap in the opening 25*a*, and the jig 8 can be inserted therein from the gap.

The release operation portion 36 may not necessarily be formed in a groove shape, it may be formed in any suitable shape as long as it extends to a rear side with respect to the engagement projection 35 and it is formed such that the jig 8 can be inserted therein from the gap. By forming the release operation portion 36 in a groove shape as in this example, it is possible to guide the jig 8 to the rear side in the fitting direction, thereby further facilitating the release operation for releasing the engagement of the arm portion 25.

An inclined surface 38 connected to the outer surface 32*a* of the plate portion 32 is formed at a rear end of the release operation portion 36. This inclined surface 38 functions to guide the jig 8 to the rear side and to the outer surface 32*a* side.

The wall portion 37 protrudes from a portion of the outer surface 32*a* of the plate portion 32 that is connected to the inclined surface 38. The wall portion 37 is positioned at a rear side with respect to the arm portion 25 engaged with the engagement projection 35.

Next, an operation for releasing the engagement of the arm portion 25 engaged with the engagement projection 35 will be explained. First, in a state where both housings 2, 3 are completely fitted to each other, the jig 8 is inserted into the gap in the opening 25*a* in a direction indicated with an arrow A1 shown in FIG. 6, and the jig 9 is pushed in a direction indicated with an arrow A2 (i.e., in the rearward direction) along the release operation portion 36. That is, the distal end of the jig 8 is moved beneath the arm portion 25. Then, as shown in FIG. 7, the jig 8 is further pushed along the inclined surface 38. Thus, the arm portion 25 is lifted in a direction indicated with an arrow A3, rendering the arm portion 25 in a ready-to-be released state. Further, as shown in FIG. 8, the jig 8 is pushed so as to abut against the wall portion 37. Thus, the male housing 3 is moved to a direction indicated with an arrow A4, and the engagement of the arm portion 25 is released and both housings 2, 3 are shifted to the provisionally-fitted state.

As described above, the connector 1 of this example can release the engagement of the arm portion 25 engaged with the engagement projection 35 with a simple operation including inserting the jig 8 into the release operation portion 36 from the gap in opening 25*a* and pushing the jig 8 in the same direction as the insertion direction. That is, the release of the engagement of the arm portion 25 can be performed by a single action, thereby improving the work efficiency.

It should be understood that the above-described embodiment is only a representative form of the present invention, and the present invention is not limited to this embodiment. That is, various modifications can be made without departing from the gist of the present invention. Such modifications, as long as they still have the configuration of the present invention, are of course within the scope of the present invention.

LIST OF REFERENCE SIGNS

1 connector
2 female housing (first housing)
3 male housing (second housing)
8 jig
25 arm portion
25*a* opening
35 engagement projection
36 release operation portion
37 wall portion
38 inclined surface

What is claimed is:

1. A connector comprising:

a first housing and a second housing that are configured to be fitted to each other;

an engagement projection formed on the second housing so as to protrude from an outer surface of the second housing;

an arm portion that is formed on the first housing and that is configured to engage with the engagement projection, the arm portion having an opening to which the engagement projection is fitted, wherein in a state where the arm portion is engaged with the engagement projection and the engagement projection is fitted to the opening, a gap for insertion of a jig exists in the opening at a lateral side of the engagement projection, the lateral side being adjacent to the engagement projection in a direction orthogonal to a fitting direction in which the second housing is fitted to the first housing, the second housing includes a release operation portion, the release operation portion being formed as a recess on the outer surface of the second housing and being arranged such that the jig is insertable from the gap, the release operation portion extending to a rear side in the fitting direction with respect to the engagement projection, and an inclined surface is formed at a rear end in the fitting direction of the release operation portion, the inclined surface being continuous with the outer surface of the second housing.

2. The connector according to claim 1, wherein the second housing includes a wall portion, the wall portion protruding from a part of the outer surface connected to the inclined surface, the wall portion being positioned at a rear part in the fitting direction of the arm portion.

3. The connector according to claim 1, wherein the release operation portion is a groove extending in the fitting direction.

4. The connector according to claim 2, wherein the release operation portion is a groove extending in the fitting direction.

* * * * *